US008307473B1

(12) United States Patent
Lambarth et al.

(10) Patent No.: US 8,307,473 B1
(45) Date of Patent: Nov. 13, 2012

(54) PATIENT TRANSFER DEVICE

(75) Inventors: Clifford E. Lambarth, Portage, MI (US); Alfred J. Dacey, IV, Mendon, MI (US); Chris Gentile, Sturgis, MI (US); Keith L. Buffinga, Hopkins, MI (US)

(73) Assignee: Stryker Coropration, Kalamazoo, MI (US)

( * ) Notice: Subject to any disclaimer, the term of this patent is extended or adjusted under 35 U.S.C. 154(b) by 0 days.

(21) Appl. No.: 13/238,555

(22) Filed: Sep. 21, 2011

(51) Int. Cl.
*A61G 5/06* (2006.01)

(52) U.S. Cl. ..... 5/81.1 R; 5/86.1

(58) Field of Classification Search ..... 5/81.1 R, 5/81.1, 86.1, 620; 280/5.22, 5.2; 180/9.1, 180/9.26
See application file for complete search history.

(56) References Cited

U.S. PATENT DOCUMENTS 3,276,531 A * 10/1966 Hale et al. ..... 180/9.23
6,648,343 B2 * 11/2003 Way et al. ..... 280/5.22

* cited by examiner

*Primary Examiner* — Fredrick Conley
(74) *Attorney, Agent, or Firm* — Warner Norcross & Judd LLP

(57) ABSTRACT

A patient transfer device including a retractable wheel assembly, a caster brake and a track extension is provided. The retractable wheel assembly can include a cammed linkage arm operatively coupled to a retractable wheel. As the patient transfer device moves downwardly over a step, the cammed linkage arm can bear against the step, rotating the retractable wheel to a stowed position. The caster brake and the track extension can cooperate to stabilize the patient transfer device at the top and bottom of a stairway, respectively. The caster brake and the track extension can each include a high-friction engagement surface that is vertically offset from the respective caster and track. The retractable wheel assembly, caster brake and track extension can improve the control the patient transfer device along level, ramped and stepped surfaces, particularly for operators lacking sufficient training or experience.

22 Claims, 14 Drawing Sheets

PATIENT TRANSFER DEVICE

BACKGROUND OF THE INVENTION

The present invention relates to patient transfer devices, and more particularly, patient transfer devices adapted to transport persons across uneven surfaces.

Patient transfer devices, including for example stair chairs, evacuation chairs and wheeled stretchers, are typically characterized apart from other devices by their ability to safely transport patients along uneven surfaces. For example, a stair chair typically includes a rearwardly-inclined rail assembly coupled to a seat assembly. In use, an operator guides the stair chair down a stairway while the rearwardly-inclined rail assembly supports the weight of the occupant, thereby providing the occupant with a controlled descent between multiple floors of a building.

Despite their widespread acceptance, patient transfer devices can become unstable or unbalanced in use, particularly for unfamiliar operators and/or larger occupants. Accordingly, there remains a continued need to improve the safety, control and reliability of patient transfer devices across a range of operators and occupants. In addition, there remains a continued need to provide improved systems and methods to leverage the benefits of existing and future patient transfer devices and to improve the control of patient transfer devices along a variety of surfaces.

SUMMARY OF THE INVENTION

The present invention provides a patient transfer device that incorporates one or more components to enhance the stability of the patient transfer device. In particular, the present invention provides a patient transfer device including a retractable wheel assembly, a caster brake and/or a track extension. These components can collectively and individually provide improved control of the patient transfer device along level, ramped, curbed and stepped surfaces and can stabilize the patient transfer device without a reliance on user-supplied control inputs. As a result, the control and functionality of the patient transfer device can be enhanced over prior art systems, particularly when the patient transfer device is operated by users lacking in sufficient training or experience.

In one embodiment, a retractable wheel assembly is provided. The retractable wheel assembly includes a retractable wheel that is moveable between a deployed position and a stowed position. In the deployed position, the retractable wheel can cooperate with rear wheels on a patient transfer device to support the weight of the occupant on substantially level surfaces. In this position, the patient transfer device can be inclined rearwardly, for example in advance of a descending stairway, or shortly after the patient transfer device has traversed a descending stairway. The retractable wheel can rotate to a stowed position when transitioning from a substantially level surface to a stepped surface. In some embodiments this transition can occur automatically, while in other embodiments this transition can be user-initiated.

The retractable wheel assembly optionally includes a linkage arm operatively coupled to the retractable wheel. The linkage arm is pinned to the patient transfer device at a first end and is operatively coupled to the retractable wheel at a second end. The linkage arm can include a downward facing cam proximate the first end, the cam being adapted to rotate the linkage arm about its pinned first end. For example, as the patient transfer device moves downwardly over a step, the cam can bear against the step, rotating the linkage arm upwardly about the pinned first end. This rotation of the linkage arm brings the retractable wheel to the stowed position. As the patient transfer device overcomes the lowermost step, the cam is free to actuate downwardly, and the retractable wheel can then return to the deployed position. Optionally, the retractable wheel is biased in the deployed position using a suitable biasing mechanism, including for example a torsion spring or a tension spring.

In another embodiment, a caster brake is provided. The caster brake is adapted to limit or prevent movement of the patient transfer device along a stepped surface while in the upright position. For example, the caster brake includes an attachment arm extending rearwardly from a caster and a grip pad extending downwardly from the attachment arm. The attachment arm is fixedly coupled to a caster, optionally extending from a forked wheel yoke. The grip pad includes a horizontally-disposed, high-friction working surface. The working surface can be vertically offset from the floor when the patient transfer device is seated on a level surface in the upright position. Optionally, the vertical offset is between approximately 0.25 inches and approximately 0.75 inches. Further optionally, the vertical offset is approximately 0.5 inches. As the front casters crest over a stair lip, the grip pad can engage the lip, limiting or preventing further forward movement of the patient transfer device in the upright position. Because the vertical offset is relatively small relative to the patient transfer device wheelbase, the patient transfer device center of gravity can remain between the front caster brake and the rear wheels, preventing forward tipping of the patient transfer device. The operator may then pivot the patient transfer device rearwardly about the rear wheels to permit a controlled descent of the patient transfer device along the stepped surface.

In still another embodiment, a track extension is provided. The track extension is adapted to slow movement of the patient transfer device at the base of a staircase. For example, the track extension extends longitudinally from a track member and includes a downward facing grip pad. The grip pad can include a high-friction engagement surface that is offset from the track member, such that the grip pad is spaced apart from the stairs during traversal of the staircase. Optionally, the vertical offset is between approximately 0.25 inches and approximately 0.75 inches. Further optionally, the vertical offset is approximately 0.5 inches. As the patient transfer device meets the lower landing at the base of the staircase, the momentum of the patient transfer device can urge the patient transfer device forward. As the patient transfer device continues forward, the track extension engages the lip of one or more bottom steps. The high-friction engagement surface can slow and in some instances stop forward movement of the patient transfer device, permitting the operator to regain control of the patient transfer device. The operator can then pivot the patient transfer device upwardly to an upright position for movement along the lower landing.

Embodiments of the invention can therefore provide a variety of systems for stabilizing a patient transfer device along level, ramped, curbed and stepped surfaces. In particular, embodiments of the invention can in many instances prevent the patient transfer device from achieving unstable orientations, often automatically, thereby improving control of the patient transfer device for both experienced and inexperienced operators. These and other advantages and features of the invention will be more fully understood and appreciated by reference to the description of the current embodiments and the drawings.

DESCRIPTION OF THE CURRENT EMBODIMENTS

Figure 1:
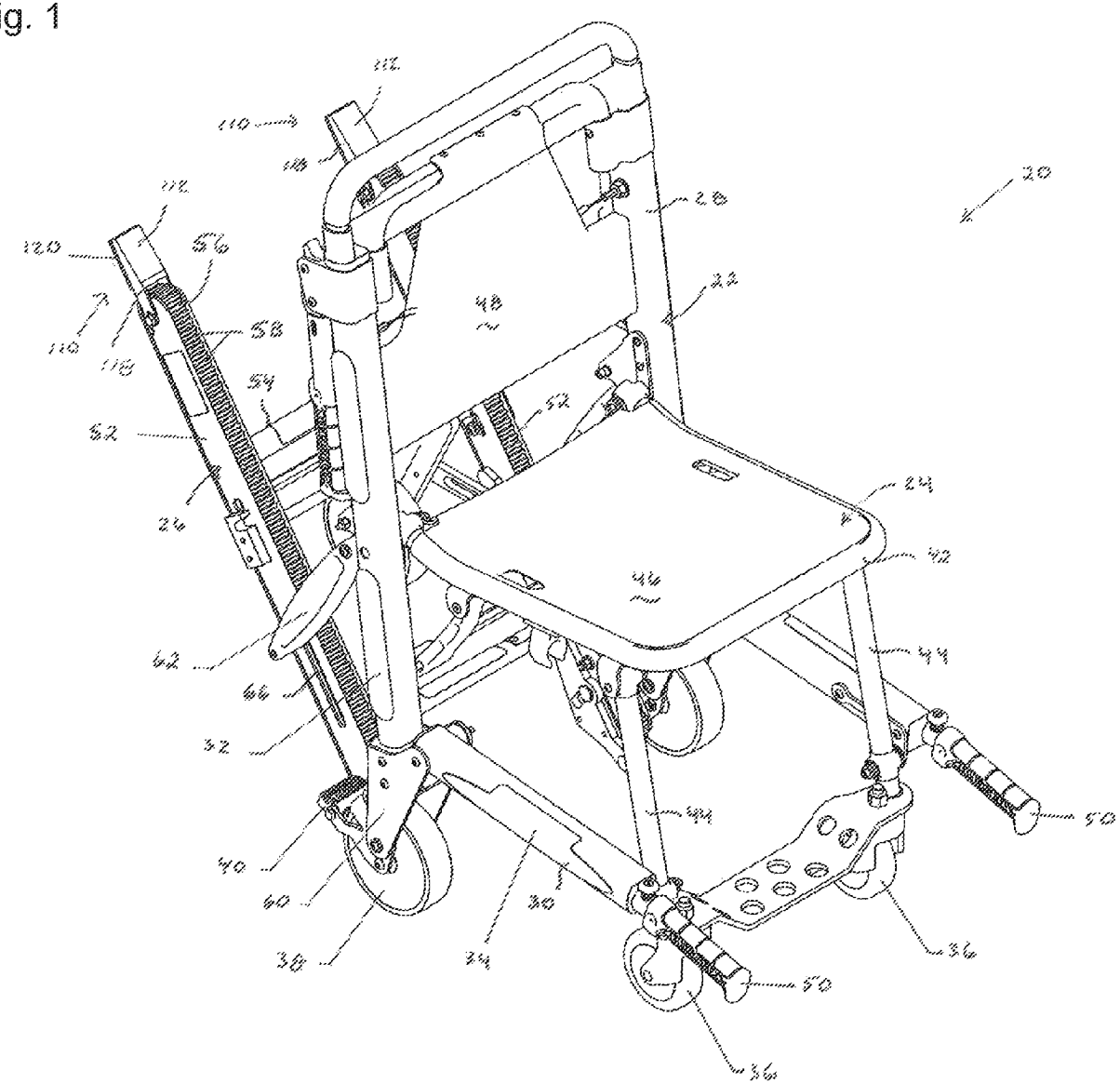
FIG. 1 is a front perspective view of a patient transfer device in accordance with an embodiment of the invention.

The current embodiments relate to a variety of systems for stabilizing a patient transfer device during use, including for example a retractable wheel, a caster brake and/or a track extension. As set forth below, these systems can be used in combination with a wide variety of patient transfer devices, including stair chairs, evacuating chairs, wheeled ambulance cots and other devices, whether now known or hereinafter developed. For example, the systems of the present invention can be utilized in connection with any of the patient transfer devices set forth in U.S. Pat. No. 6,648,343 to Way et al, filed Jan. 14, 2002, and U.S. Patent Application Publication 2010/0117312 to Walkingshaw et al, filed Aug. 28, 2009, the disclosures of which are incorporated by reference in their entirety.

Referring now to FIGS. 1-14, a patient transfer device including embodiments of the present invention is illustrated and generally designated 20. The patient transfer device 20 includes a frame assembly 22, a seat assembly 24 and a deployable track assembly 26. The frame assembly 22 includes vertical and horizontal tubular members 28, 30 for forming a back portion 32 and a base portion 34. The base portion 32 can be pivotably connected to the back portion 34, and can be supported at respective corners by front casters 36 and rear wheels 38. The front casters 36 are rotatably attached to the base portion 34 at a forward portion thereof, and optionally swivel about a vertical axis to permit turning of the patient transfer device 20 on level surfaces. The rear wheels 38 are rotatably attached to the base portion 34 at a rearward portion thereof, and in some embodiments can also swivel about a vertical axis. In the illustrated embodiment, the rear wheels 38 may remain fixed in a forward orientation and are rotatable about a common axis of rotation. Optionally, the rear wheels 38 can include one or more brake pedals 40 attached thereto.

The seat assembly 24 includes any suitable assembly for supporting a patient in a sitting position or in a reclined position. As shown in FIGS. 1-4, for example, the seat assembly 24 can include a generally U-shaped frame 42 that is pivotably secured to the back portion 28. The U-shaped frame 42 can be interconnected with the base portion 34 through laterally spaced-apart support rods 44. The support rods 44 can be pivotably joined to the U-shaped frame 42 at a first end thereof, and can be pivotably joined to the base portion 34 at a second end thereof. The seat assembly 24 includes a seat 46 and an optional seat back 48 mounted between portions of the U-shaped frame 42 and the back portion 32, respectively. When the seat assembly 24 is in the deployed position as shown in FIG. 1, left and right support handles 50 project forward from the base 34. The handles 50 can be slidable, pivotable or otherwise retractable from the base 34 to provide added leverage during movement of the patient transfer device 20. A corresponding pair of rear handles 51 is shown as extending rearwardly from the frame assembly 22. The rear handles 51 aid the operator in pushing the patient transfer device 20 along level surfaces and guiding the patient transfer device 20 along stepped surfaces. When the seat assembly 24 is in the stowed position, the base 34 and U-shaped frame 42 pivot upwardly relative to the back 32 to a locked and stowable configuration.

Figure 2:
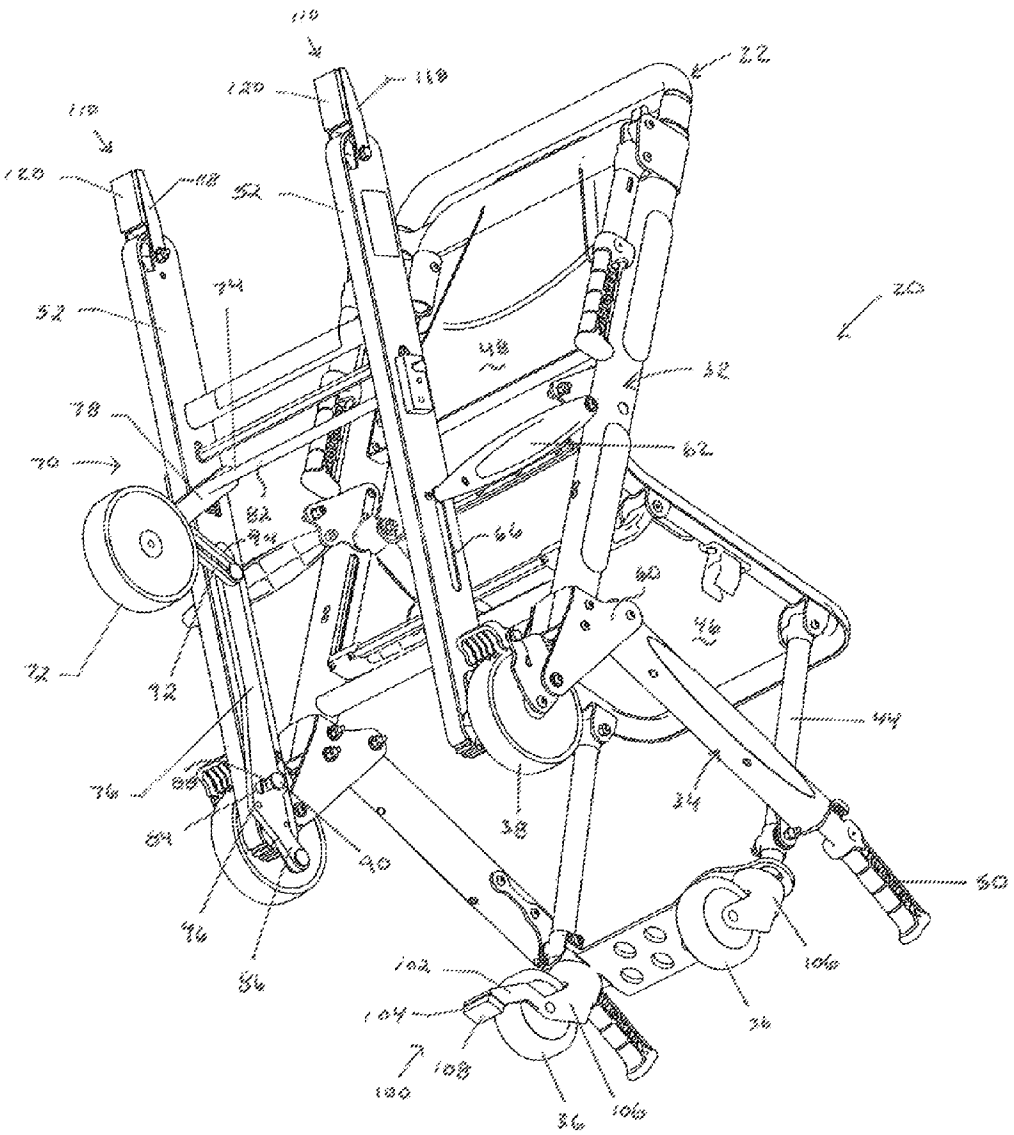
FIG. 2 is a bottom perspective view of the patient transfer device of FIG. 1.
Figure 3:
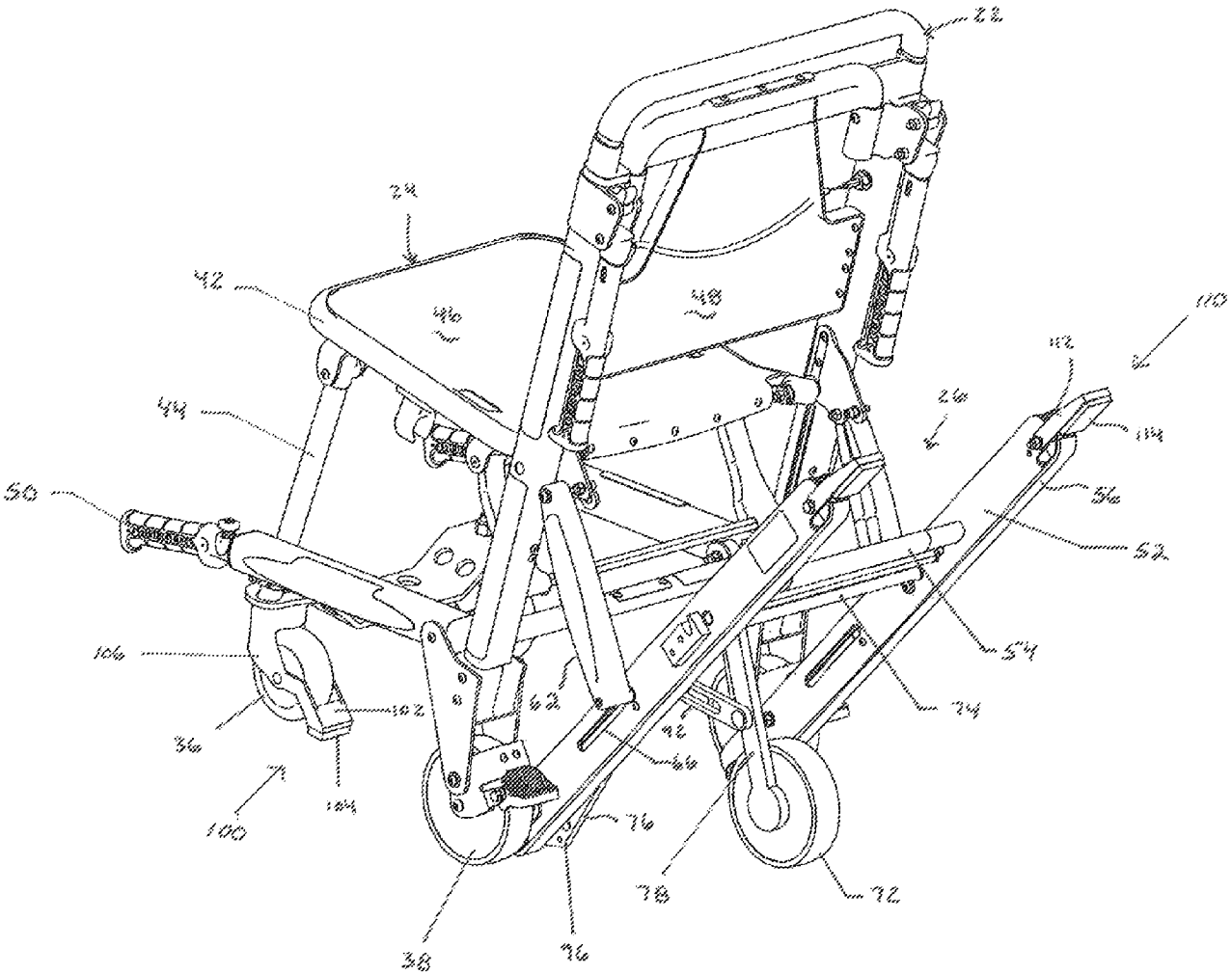
FIG. 3 is a back perspective view of the patient transfer device of FIG. 1.

As also shown in FIGS. 1-4, the patient transfer device 20 includes a track assembly 26 that is selectively moveable from a stowed position adjacent the back portion 32 of the frame assembly 22 to a deployed position for engagement with one or more steps of a stairway. The track assembly 26 includes a pair of laterally spaced-apart track members 52 that are interconnected through at least one transverse support 54. The transverse support 54 is secured to the track members according to any suitable technique, including for example welding. In the illustrated embodiment, each track member 52 includes a continuous looped track belt 56 supported by internal end pulleys at respective ends thereof. The track members 52 can optionally include internal rollers or idler pulleys against a surface of the track belts 56 remote from the steps. The track belts 56 include teeth or ribs 58 as shown in the illustrated embodiment, but can alternatively be smooth surfaced. The track members 52 are pivotably coupled to the frame assembly 22 at a lower portion thereof by a bracket 60. In some embodiments, the track assembly 26 is pivotable about a horizontal axis that is offset from the rear wheel horizontal axis. In other embodiments, the track assembly 26 and the rear wheels 38 are coaxial. As best shown in FIG. 2, each track member 52 is coupled to the back portion 32 through a brace 62. Each brace 62 can include a first end that is rotatably coupled to the back portion 32 and a second end that is slideably and rotatably coupled to a respective track member 52. For example, each brace 62 can include a second end that includes a transverse pin 64 received within an elongate slot 66 in the track member 52.

I. Retractable Wheel Assembly

Figure 4:
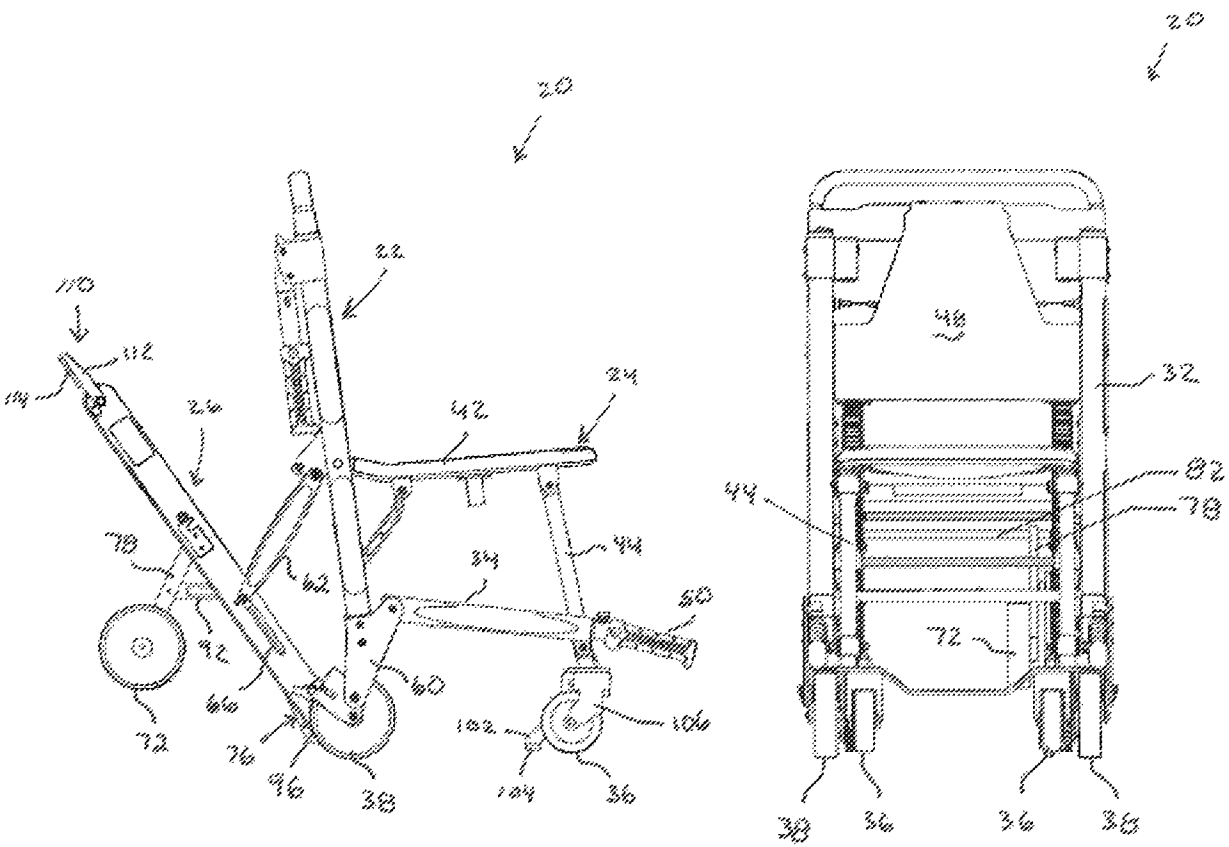
FIG. 4 includes elevational views of the patient transfer device of FIG. 1.
Figure 5:
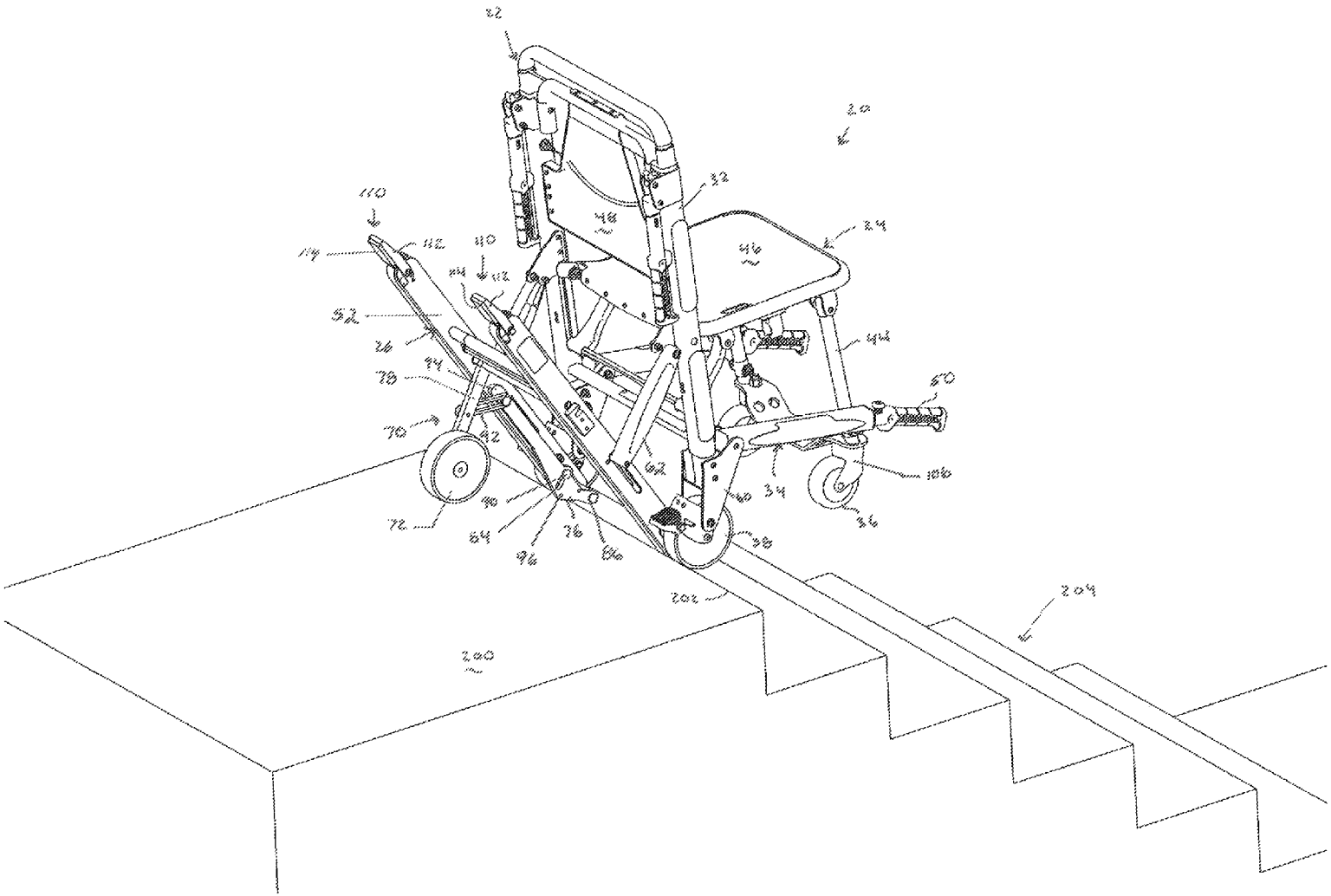
FIG. 5 is a perspective view of a patient transfer device with a deployed wheel.

As noted above, in one embodiment the patient transfer device 20 includes a retractable wheel assembly 70 that cooperates with the rear wheels 38 to support the weight of the patient transfer device 20 on substantially level surfaces. Referring now to FIGS. 1-10, the wheel assembly 70 includes a retractable wheel 72 that extends downwardly or outwardly from between the track members 52 in a deployed position, and is retracted, for example, to generally between the track members 52 in a stowed position. In the deployed position, the retractable wheel 72 assists in stabilizing the patient transfer device 20 as it approaches the first step in an ascending or descending staircase, but generally not during the respective ascent or descent. As best illustrated in FIG. 5, and before the patient transfer device 20 is positioned to descend a staircase, an operator may rock the chair 20 back about its rear wheels 38 and onto the retractable wheel 72 so that the seat assembly 24 is tilted back. Once the back wheels 38 are at the top step, for example, the retractable wheel 72 can move from its deployed position to its stowed position when transitioning from a substantially level surface to one or more stairs of a staircase. In like manner, the retractable wheel 72 can also move from a stowed position to a deployed position when transitioning from one or more stairs to a substantially level surface. In some embodiments this transition can occur automatically, while in other embodiments this transition can be controlled by the user substantially as set forth below in connection with FIGS. 9-10.

Figure 7:
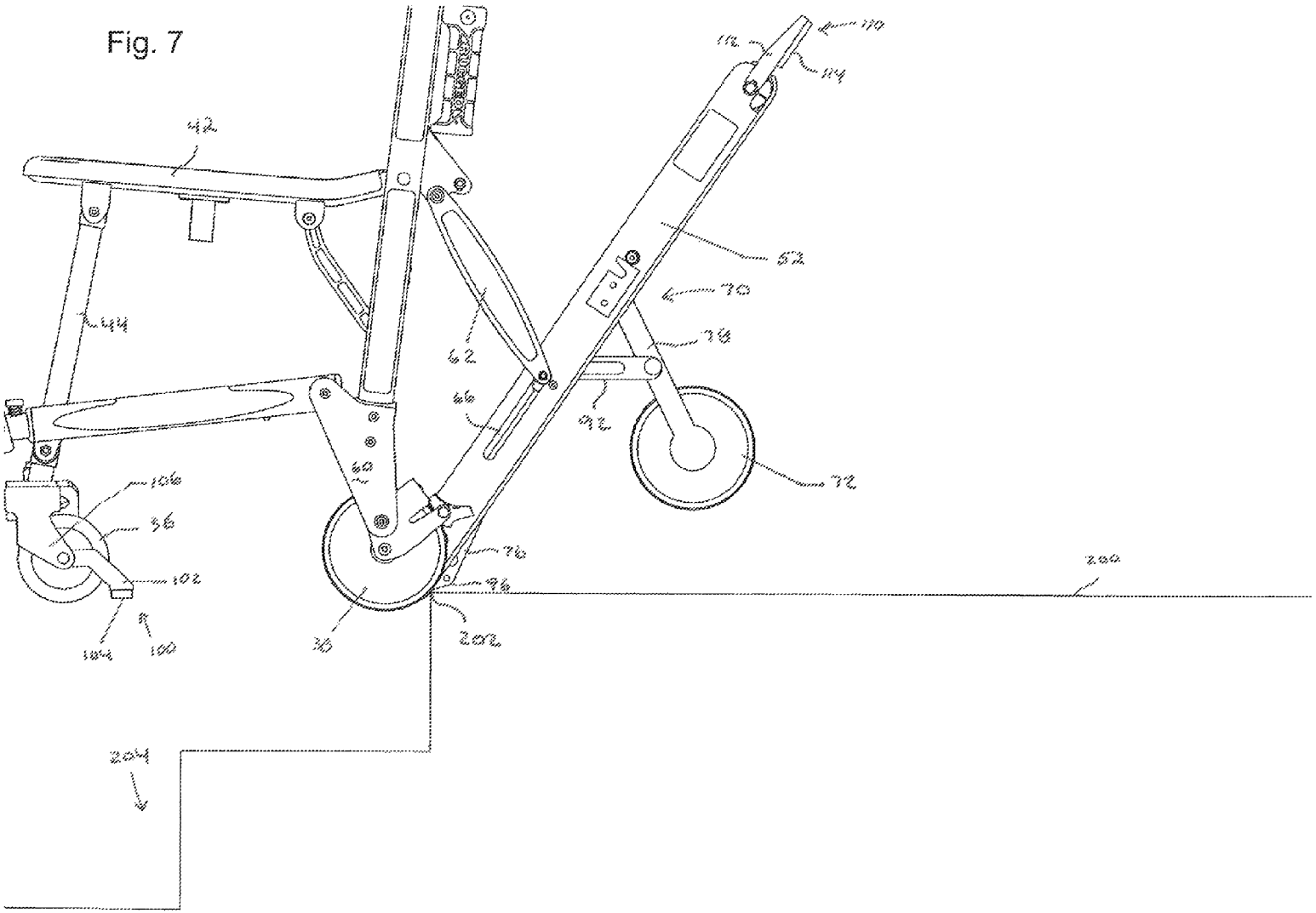
FIG. 7 is a side view of a patient transfer device with a deployed wheel.
Figure 8:
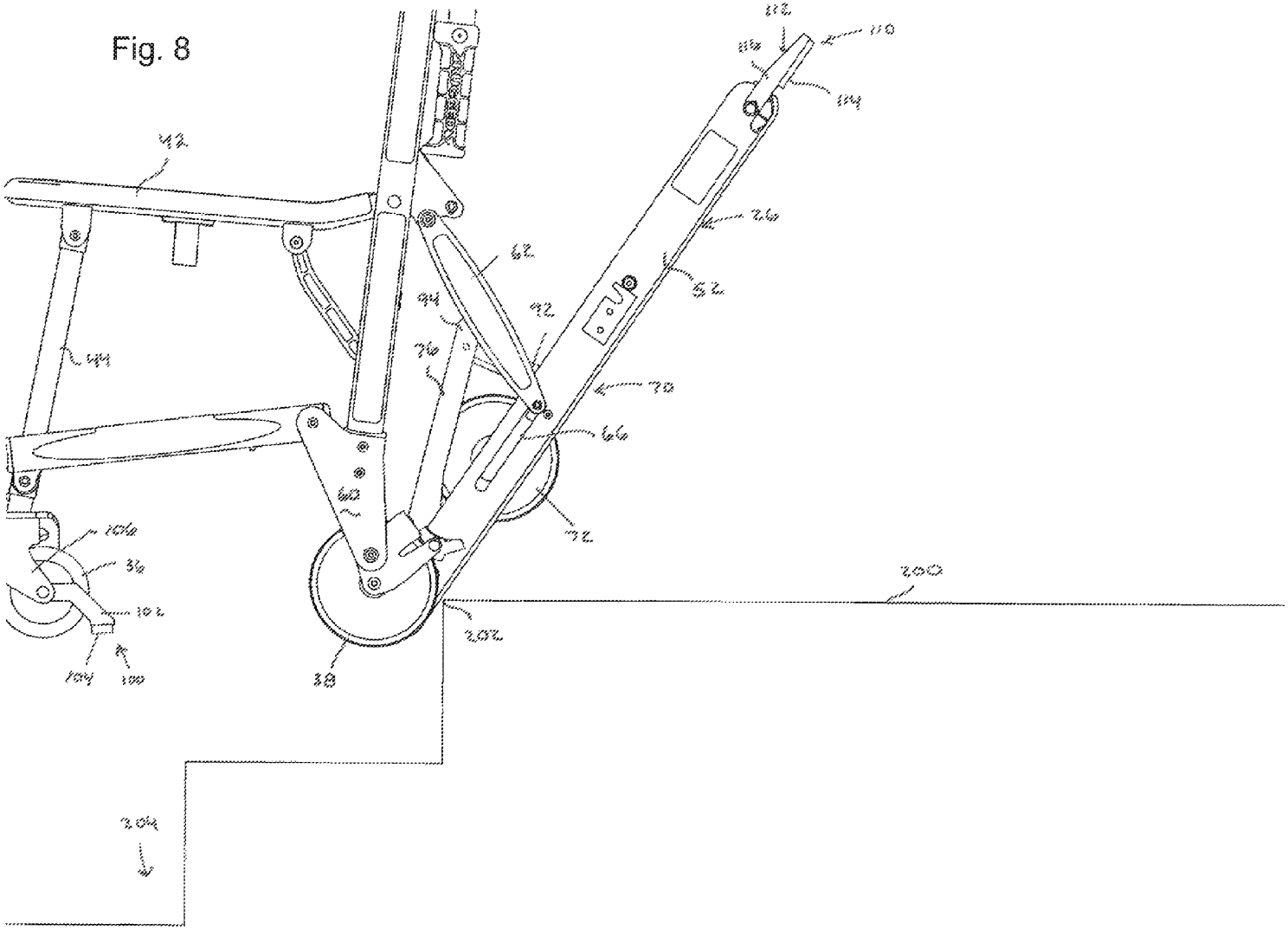
FIG. 8 is a side view of a patient transfer device with a stowed wheel.

Referring again to FIG. 2, the retractable wheel assembly 70 includes a wheel mount 74 and a linkage arm 76 to actuate the wheel mount 74. The wheel mount 74 can include the above-mentioned wheel 72 and a strut 78. The strut 78 can include a cantilever mount 80 that rotatably supports the wheel 72 about a horizontal axis of rotation. In addition, the strut 78 can rotate relative to the track assembly 26 between a deployed position as generally shown in FIG. 7 and a retracted position as generally shown in FIG. 8. For example, the strut 78 can be pivotably mounted about a transverse member 82 extending between spaced-apart track members 52. The wheel mount 74 can be biased in the deployed position utilizing any suitable biasing mechanism. For example, the wheel mount 74 can include a torsion spring, tension spring or other mechanism to urge the wheel mount 74 into the deployed position.

As noted above, at least one of the track members 52 includes a linkage arm 76 to overcome the biasing force and rotate the retractable wheel 72 from the deployed position to the stowed position. As optionally shown in FIG. 2 for example, the linkage arm 76 is pivotable relative to the rear wheels 38, such that a generally upward rotation of the linkage arm 76 about the rear wheels 38 will urge the retractable wheel 72 into a stowed position. The linkage arm 76 includes an arcuate-transverse slot 84 proximate a first end portion 86 to receive a guide pin 88 from the track member 52. Thus, the guide pin 88 and the arcuate transverse slot 84 cooperate to limit rotation of the linkage arm 76 to a desired range, optionally approximately 20 to 45 degrees, further optionally 15 to 60 degrees, and still further optionally outside or within these ranges. The guide pin 88 further includes an oversized head 90 spaced apart from the track member 52 to retain the linkage arm 76 therebetween.

The linkage arm 76 is rotatably coupled to a pivot arm 92 at its second end portion 94. The pivot arm 92 interconnects the linkage arm 76 and the wheel strut 78, such that upward rotation of the linkage arm 76 retracts the wheel 72 to the stowed position. As noted above, movement of the wheel 72 can occur automatically in some embodiments, while in other embodiments the wheel 72 can rotate to a stowed position in response to a user-supplied control input. In the illustrated embodiment, the wheel 72 automatically rotates to the stowed position in response to the rear wheels 38 cresting over the first step in a descending staircase. In addition, the wheel 72 is maintained in the stowed position in response to the track assembly 26 being inclined sufficiently rearwardly on a substantially level surface. In particular, the linkage arm 76 includes a cam 96 protruding downwardly therefrom, such that the cam 96 is actuated upwardly by each stair lip, or by a level surface, until the cam 96 is flush with the adjacent track member 52 when viewed from the side. The cam 76 can be located between the first and second end portions 86, 94, and optionally nearer to the first end portion 86. The cam 96 can include any desired shape to convert a linear and generally upward movement of the cam 96 into a rotation of the linkage arm 76. In the illustrated embodiment, the cam 96 includes a generally triangular side profile to engage a step in both the forward and rearward directions, though other configurations can also be utilized as desired.

Figure 6:
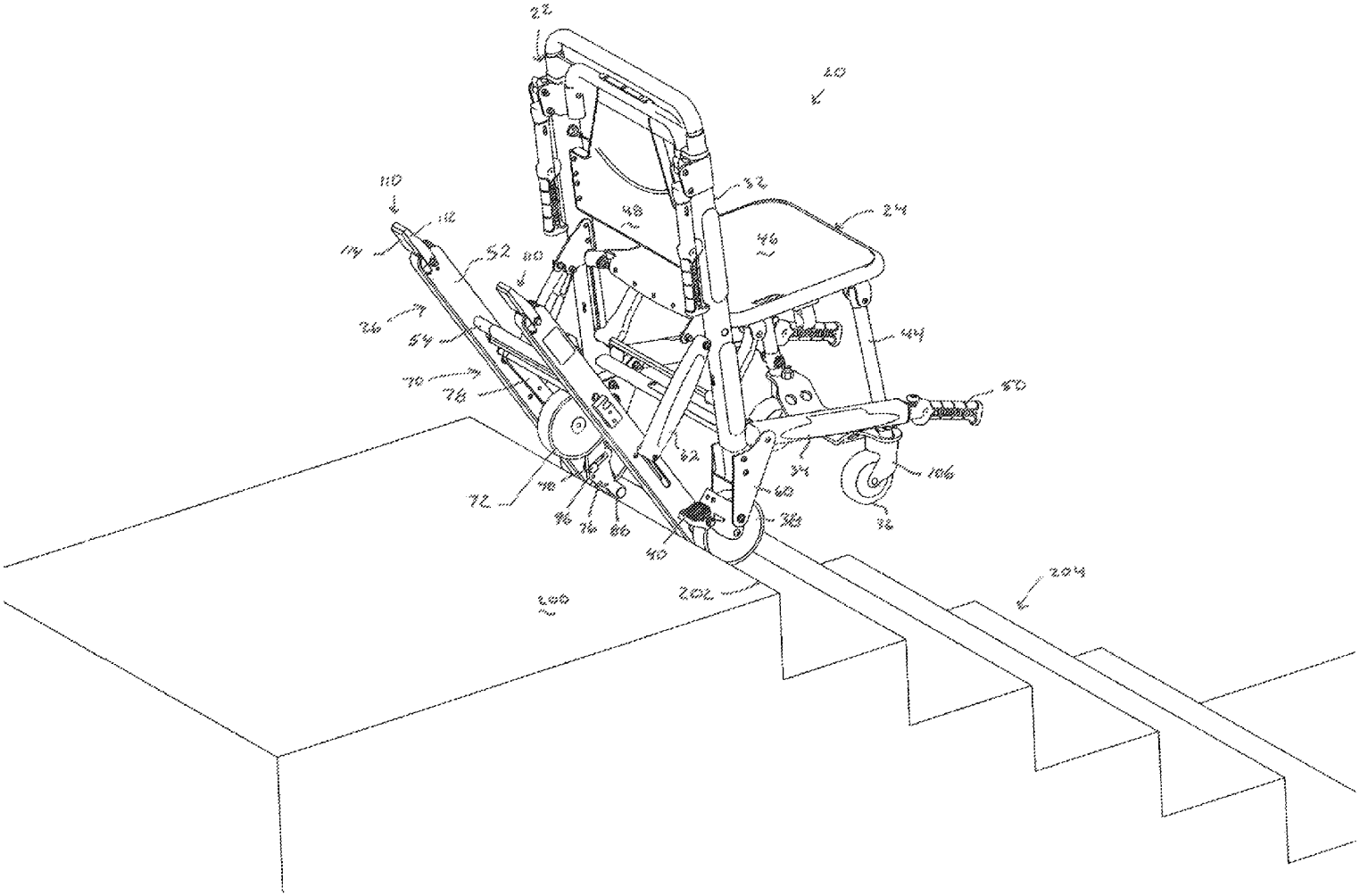
FIG. 6 is a perspective view of a patient transfer device with a stowed wheel.

Operation of the retractable wheel assembly 70 is further understood with reference to FIGS. 5-8. As shown in FIGS. 5 and 7, the retractable wheel assembly 70 is biased in the deployed position. A suitable biasing mechanism can include a torsion spring mounted about the transverse member 82 or a tension spring extending between the wheel assembly 70 and the frame assembly 22. In this position, the cam 96 remains spaced apart from the floor 200. As the rear wheels 38 crest over the lip 202 in a descending staircase 204, the cam 96 will bear against the lip 202, actuating the cam 76 upwardly. The upward actuation of the cam 96 promotes a rotation of the linkage arm 76 about the first end portion 86. The rotation of the linkage arm 76 imparts a corresponding rotation of the retractable wheel 72 through the pivot arm 92, bringing the retractable wheel 72 to the stowed position as shown in FIGS. 6 and 8. As the patient transfer device 20 continues downwardly along the stairway 204, the track members 52 bear against each step to support the weight of the patient transfer device 20 and its occupant. Throughout the traversal of the remaining steps, the cam 96 also remains in contact with one or more steps, maintaining the retractable wheel 72 in the stowed position. As the rear wheels 38 overcome the lowermost step, the patient transfer device 20 can be rotated to an upright position. In this position, the cam 96 can actuate downwardly, thus rotating the retractable wheel 72 to the deployed position. Movement of the patient transfer device 20 in the reverse direction operates to retract the wheel 72 substantially as set forth above. That is, ascending movement of the patient transfer device 20 can cause the cam 96 to bear against each step, thereby actuating the retractable wheel 72 to the stowed position during traversal of the staircase 204.

Figure 9:
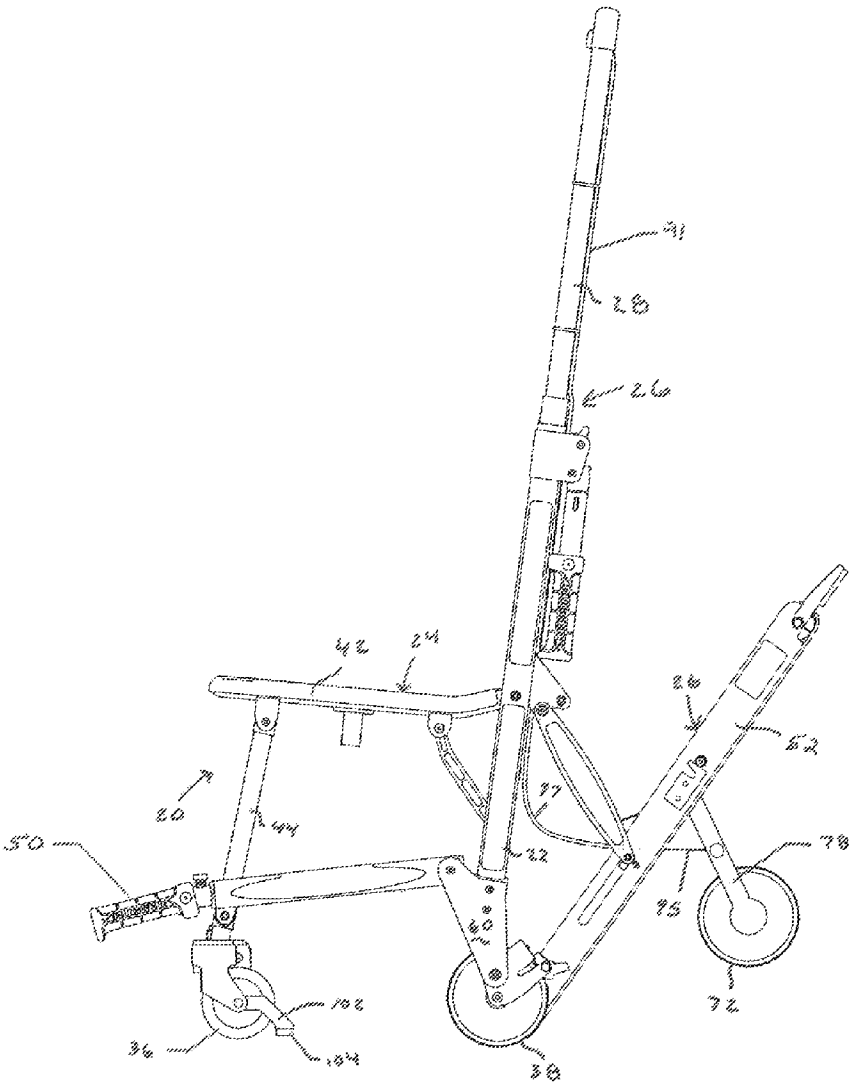
FIG. 9 is a side elevational view of a patient transfer device including a manually actuated stowable wheel assembly.
Figure 10:
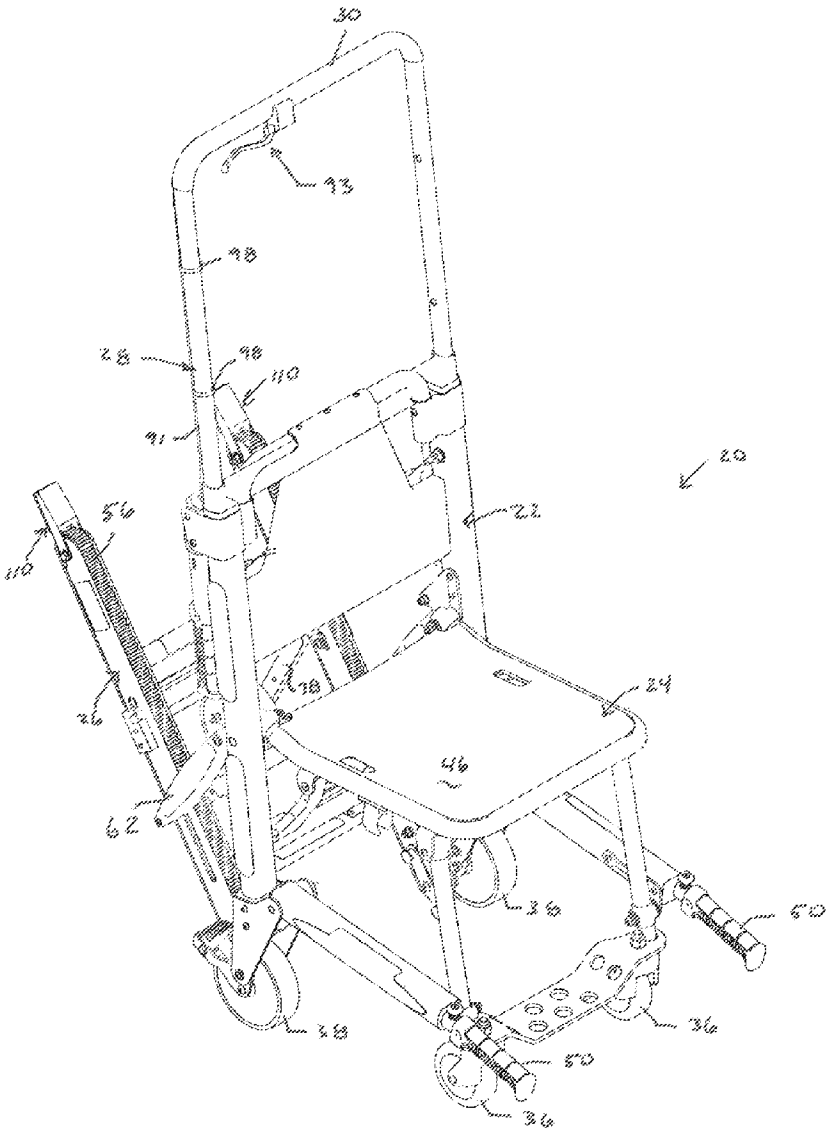
FIG. 10 is a top perspective view of the patent transfer device of FIG. 9.

In some embodiments, the wheel assembly 70 is manually retracted in addition to, or in place of, automatic retraction of the wheel assembly 70. As shown in FIGS. 9-10, the wheel assembly 70 includes a cable assembly 91 coupled to a hand controller 93 for rotating the strut 78 about the transverse member 82. The cable assembly 91, for example a Bowden cable, includes an inner cable 95 that slides within a sheath or outer sleeve 97. The inner cable 95 is connected at a first end to the hand controller 93 and at a second end to the strut 78. The cable assembly 91 includes a suitable mechanical advantage such that actuation of the hand controller 91 overcomes the biasing force and results in retraction of the wheel 72 to the stowed position.

As also shown in FIGS. 9-10, the hand controller 93 is mounted to the underside of the horizontal member 30. The outer sleeve 97 extends along the horizontal and vertical members 28, 30, being secured thereto by one or more retaining bands or straps 98. The outer sleeve 97 terminates in an opening approximately midway between the laterally spaced apart track members 52. In the deployed position as shown in FIG. 10, the inner cable 95 is visible between this opening and its point of attachment to the strut 78. In the retracted position, the inner cable 95 recedes within the outer sleeve 97 to rotate the strut 78, and consequently the wheel 72, to the stowed position.

As the operator approaches a descending stairway, manual actuation of the hand controller 93 results in the retraction of the wheel 72. Pressure on the hand controller 93 maintains the wheel 72 in the stowed position. The operator can release pressure on the hand controller 93 at the base of the stairway and return the patient transfer device 20 to the upright position as shown in FIG. 10. In some embodiments the cable assembly 91 and the hand controller 93 are utilized in combination with the cam-actuated linkage arm 76. For example, a combined manual-automatic retraction system can prove beneficial in traversing ramped and stepped surfaces. The operator can manually stow the retractable wheel 72 using the hand controller 93 before inclining the patient transfer device 20 rearwardly along a low-grade ramp. During traversal of a stepped surface, the automatic system takes over, ensuring the stowable wheel 72 is retracted substantially as set forth above.

II. Caster Brake

Figure 11:
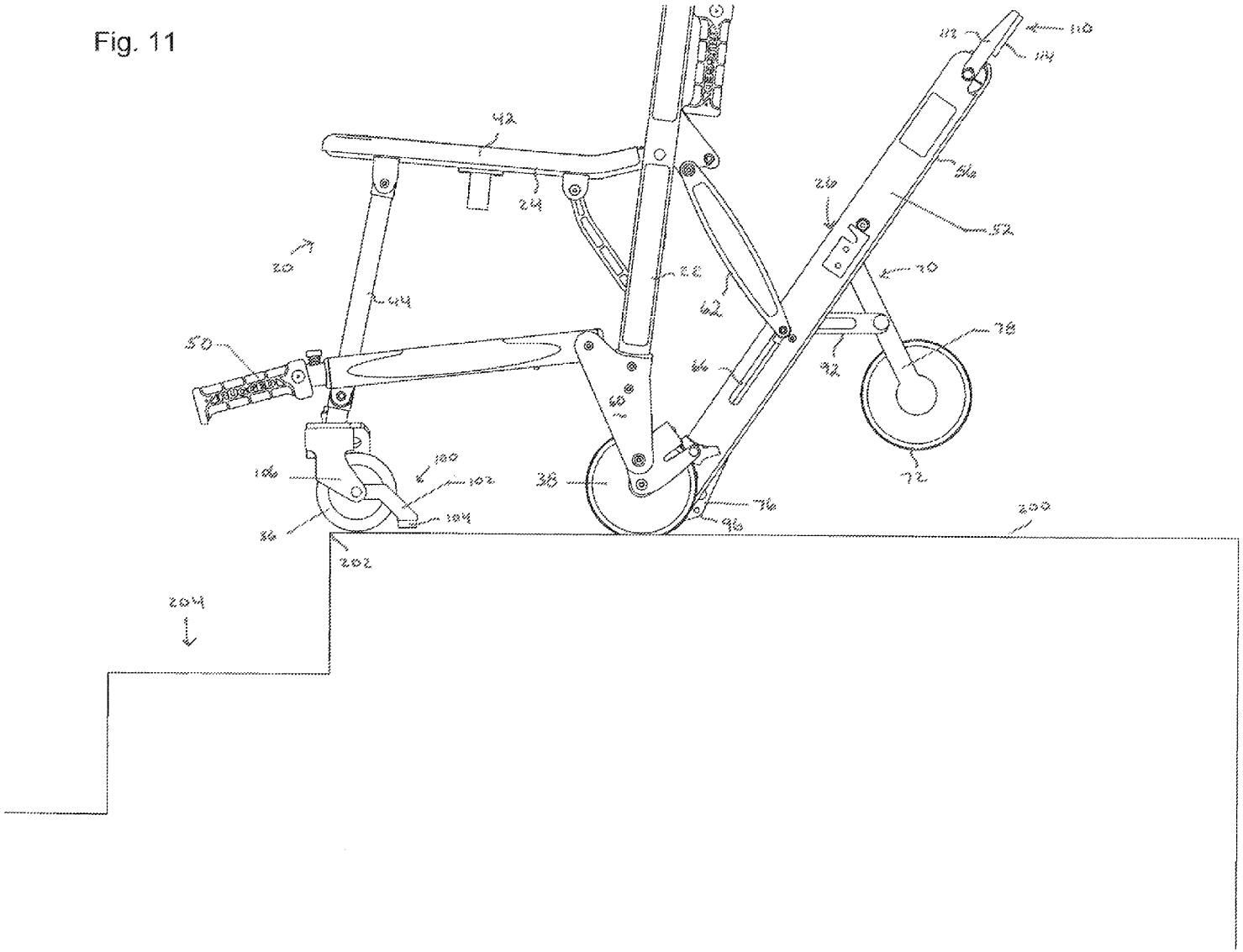
FIG. 11 is a side view of a patient transfer device illustrating a caster brake.
Figure 12:
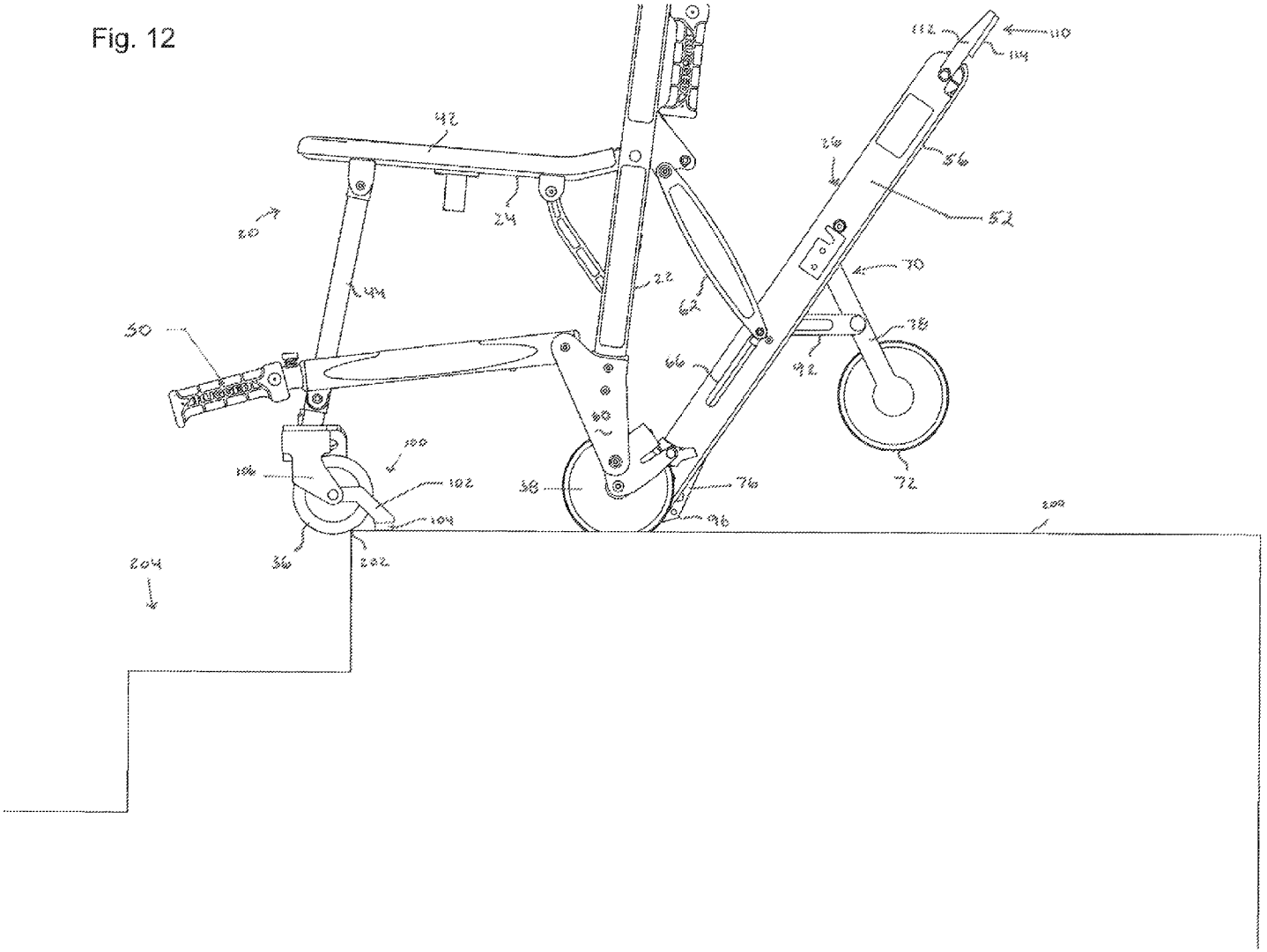
FIG. 12 is a side view of the patient transfer device illustrating the caster brake in engagement with a staircase.

The patient transfer device 20 further includes a brake 100 adapted to limit forward movement of the patient transfer device 20 as the patient transfer device 20 approaches a staircase. Referring now to FIGS. 11-12, the brake 100 includes a cantilevered attachment arm 102 and a grip pad 104 extending downwardly therefrom. The attachment arm 102 is optionally height-adjustable and can be fixedly coupled to the base 34 proximate a front caster 36. For example, the attachment arm 102 can extend rearwardly from a forked wheel yoke 106 of the left or right front casters 36. The grip pad 104 can extend downwardly from the cantilevered attachment arm 102, being spaced rearwardly from the caster 36 and including a horizontally-disposed high-friction working surface 108. The working surface 108 may comprise any suitable high-friction surface, including for example an elastomeric material. The working surface 108 is vertically offset from the lowermost surface of the front caster 36, such that the working surface 108 is spaced apart from the floor 200 when the patient transfer device 20 is resting on the front casters 36 in the upright position. For example, the working surface 108 can be spaced apart from the floor by between 0.25 inches and 1 inch, optionally approximately 0.5 inches, and further optionally greater or less than 0.5 inches.

During movement of the patient transfer device 20 over level surfaces, the brake 100 will generally not impede movement of the patient transfer device 20. However, as the front casters 36 crest over the stair lip 202, the brake 100 will engage the lip 202, limiting and/or preventing further forward movement of the patient transfer device 20 in the upright position. At this point, the patient transfer device 20 may have come to rest at the edge of the staircase 204, having dropped the front end by an amount equal to the aforementioned vertical offset—approximately 0.5 inches in the present embodiment. Because the vertical offset is nominal relative to the overall wheelbase, the patient transfer device center of gravity can remain between the front brake 100 and the rear wheels 38, preventing the forward tipping of the patient transfer device 20. The operator may then pivot the patient transfer device 20 rearwardly, bringing the retractable wheel 72 into contact with the landing 200. In this inclined position, the rear wheels 38 and the retractable wheel 72 cooperate to support the weight of the patient transfer device 20. The patient transfer device 20 can then proceed forward until the track members 52 engage the staircase 204, permitting a controlled descent of the patient transfer device 20 substantially as set forth above.

III. Track Extensions

As noted above, the patient transfer device 20 can further optionally include track extensions 110 to slow movement of the patient transfer device 20 at the base of a staircase. For example, when the patient transfer device 20 reaches the base of a staircase 204, the patient transfer device 20 can accelerate beyond the control of the operator. As described below in connection with FIGS. 13-14, track extensions 110 automatically assist in slowing or stopping the patient transfer device 20 as the patient transfer device 20 reaches the base of the stairway.

Figure 13:
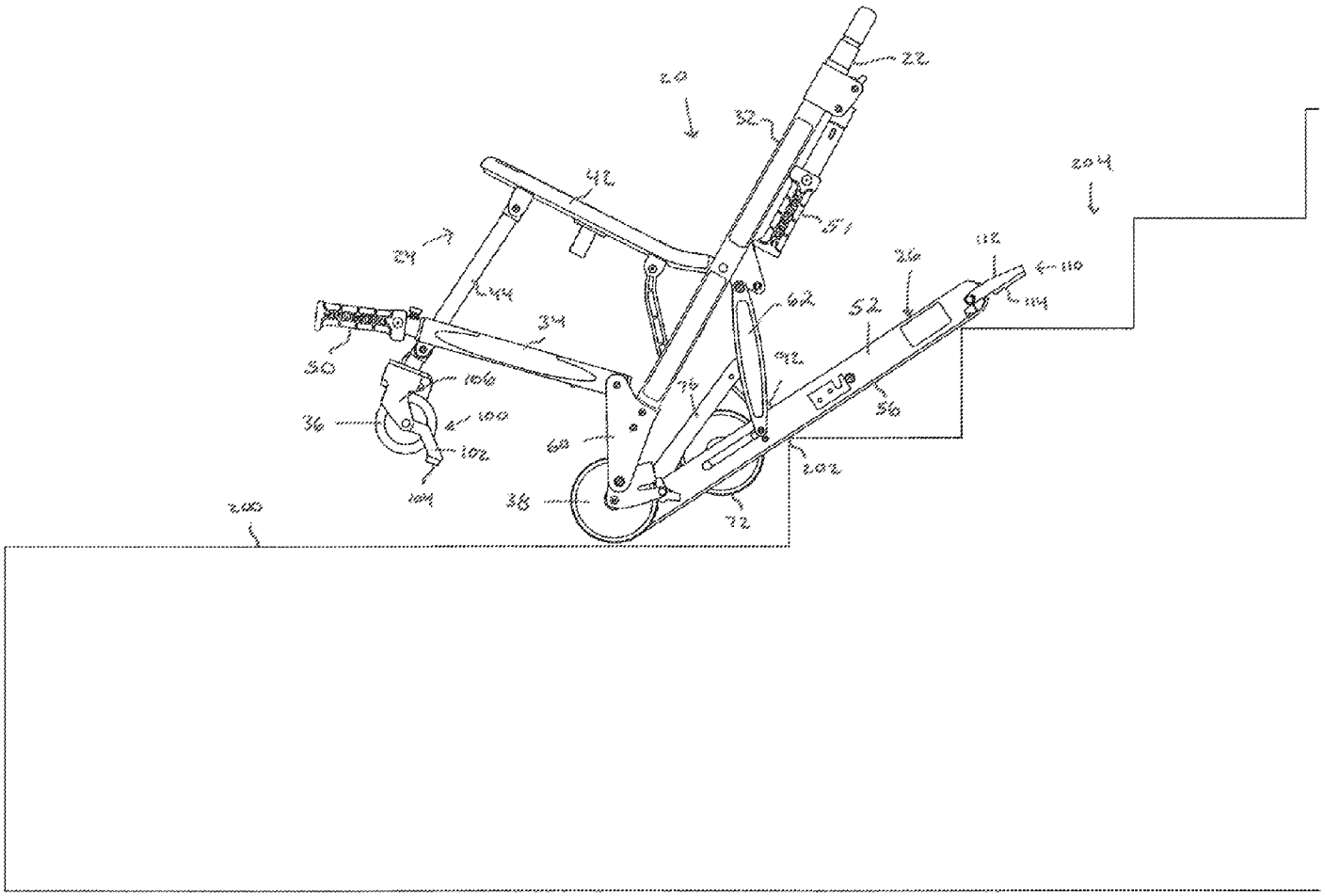
FIG. 13 is a side view of a patient transfer device illustrating a track extension.
Figure 14:
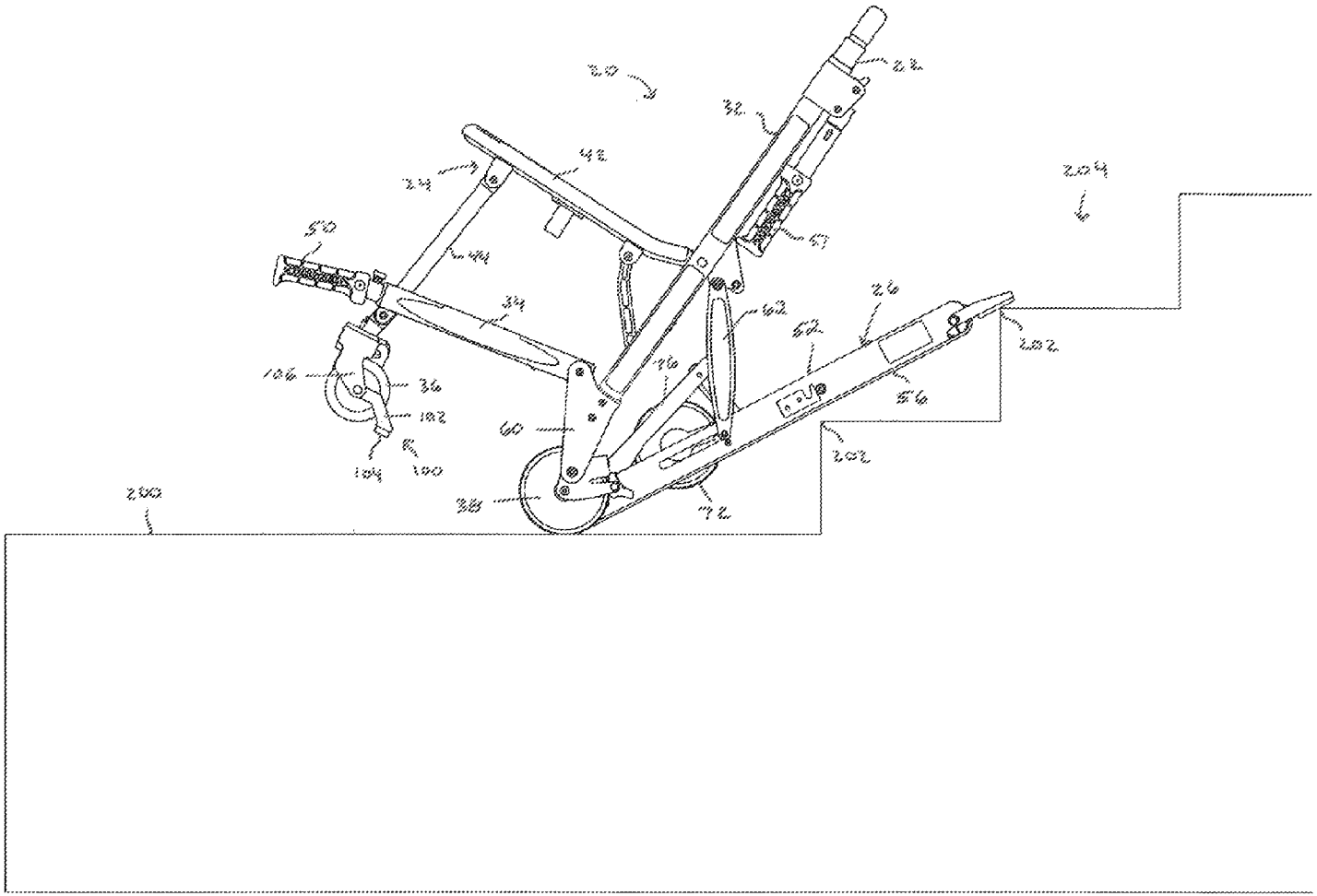
FIG. 14 is a side view of a patient transfer device illustrating a track extension in engagement with a staircase.

Referring now to FIGS. 13-14, the track members 52 include a track extension 110 extending longitudinally therefrom, the track extension 110 being generally offset from the track members 52. In the illustrated embodiment, the track extensions 110 include a carrier 112 and a grip pad 114. The carrier 112 may include left and right spaced apart sidewalls 116, 118 for supporting the grip pad 114 therebetween. In other embodiments, however, the carrier 112 may include any rigid member adapted to support a grip pad 114 longitudinally-rearwardly of the track member 52. For example, the carrier 112 alternatively may include an extruded aluminum "L" shaped beam that is bolted to the track member 52 at two or more locations along its length to prevent its rotation relative to the track member 52. In this configuration, the grip pad 114 can be adhesively bonded to the base of the "L" shaped beam to engage the lip of one or more steps. Further, the grip pad 114 may optionally be dimensioned to span two or more steps, while in other embodiments the grip pad 114 may be dimensioned to rest on no more than a single lip at a given time. The grip pad 114 can be formed of any suitable high-friction material, including an elastomeric material for example. In this manner, the grip pads 114 provide an engagement surface 120 that is an extension of the track members 52 and further optionally that is offset from the track members 52 such that a portion of the track members 52 are positioned below the grip pads 114. For example, the grip pad engagement surface 120 can be offset by between 0.25 inches and 1 inch, optionally approximately 0.5 inches, and further optionally greater or less than 0.5 inches.

During movement of the patient transfer device 20 along a descending staircase, the track extensions 110 will generally not impede movement of the patient transfer device 20, being spaced apart from each step by approximately 0.5 inches in the present embodiment. However, as the rear wheels 38 proceed forwardly at the base of the staircase, momentum can urge the patient transfer device 20 forward, potentially initiating a run-away condition as shown in FIG. 13. As the patient transfer device 20 continues forwardly, the track extensions 110 can engage the lip on one or more of the remaining steps as shown in FIG. 14. The high friction engagement surface 120 can slow and in some instances stop forward movement, permitting the operator to regain control of the patient transfer device 20. The operator may then pivot the patient transfer device 20 forwardly, returning the patient transfer device 20 to an upright condition as generally shown in FIG. 4.

As noted above, the above-described systems can be used in combination with each other or separately from each other in patient transfer devices and other devices. For example, in some embodiments the caster brakes 100 and track extensions 110, but not the retractable wheel assembly 70, can be used in combination with each other, while in other embodiments only the caster brakes 100 and not the track extensions 110 or the retractable wheel assembly 70 can be utilized. The above embodiments therefore provide improved systems for stabilizing the patient transfer device 20 before, during and after its stairway descent.

As used above, directional terminology, including upper/lower, radial/longitudinal, vertical/horizontal, inward/outward and inner/outer, is not intended to limit the present invention, and is instead used for clarity when referring to the accompanying drawings. It is also understood that ordinal terminology (such as "first," "second," "third" and so on) is used merely to indicate a particular feature, so as to distinguish from another feature described by the same term or a similar term. It will be understood that the mere usage of ordinal terminology does not define a numerical limit to the number of features identified.

The above descriptions are those of the current embodiments of the invention. Various alterations and changes can be made without departing from the spirit and broader aspects of the invention. Any reference to elements in the singular, for example, using the articles "a," "an," "the," or "said," is not to be construed as limiting the element to the singular.

The invention claimed is:

1. A patient transfer device comprising:

a seat assembly adapted to support an occupant of the patient transfer device;

a pair of wheels rotatably supported at a base portion of the seat assembly;

a track assembly coupled to the seat assembly and including a first track member to support the patient transfer device across a plurality of steps; and a retractable wheel assembly coupled to the track assembly including a retractable wheel and a linkage arm extending rearwardly of the pair of wheels and operatively coupled to the retractable wheel, the retractable wheel being adapted to rotate between a deployed position and a stowed position, wherein actuation of the linkage arm operates to rotate the retractable wheel to the stowed position, the actuation being free from a user-supplied control input.

2. The patient transfer device of claim 1 wherein the linkage arm is pivotably attached to the first track member.

3. The patient transfer device of claim 1 wherein the linkage arm includes a downwardly extending cam to sequentially engage each of the plurality of steps.

4. The patient transfer device of claim 1 further including a second track member and a transverse member extending between the first and second track members, the retractable wheel being rotatable about the transverse member.

5. The patient transfer device of claim 1 wherein the retractable wheel is biased in the deployed position.

6. The patient transfer device of claim 1 wherein the seat assembly is adapted to support the occupant of the patient transfer device in at least one of the sitting position and the reclined position.

7. A patient transfer device moveable between an upright position and a reclined position, the patient transfer device comprising:

a seat adapted to support an occupant;

a track adapted to support the seat chair across a plurality of steps; and a base assembly coupled to the seat and to the track, the base assembly including first and second casters, at least one of the first and second casters including a caster brake having an attachment arm and a downward-facing grip pad attached thereto, the grip pad being adapted to bear against a stepped surface to automatically impede movement of the patient transfer device along the stepped surface while the patient transfer device is in the upright position.

8. The patient transfer device of claim 7 wherein the grip pad includes a generally horizontal working surface.

9. The patient transfer device of claim 8 wherein the generally horizontal working surface is rearwardly offset from the first and second casters.

10. The patient transfer device of claim 8 wherein the generally horizontal working surface is vertically offset from the lowermost portion of the first and second casters.

11. The patient transfer device of claim 7 wherein the first and second casters include a forked wheel yoke, the attachment arm extending rearwardly from the forked wheel yoke of one of the first and second casters.

12. The patient transfer device of claim 7 wherein the seat is adapted to support the occupant of the patient transfer device in at least one of the sitting position and the reclined position.

13. A patient transfer device for traversing a plurality of steps, comprising:

a seat assembly adapted to support an occupant of the patient transfer device;

a pair of wheels rotatably supported at a base portion of the seat assembly;

a track assembly coupled to the seat assembly and including first and second track members extending rearwardly of the pair of wheels to support the patient transfer device across a plurality of descending steps; and a track extension coupled to a trailing portion of the first track member, the track extension defining a braking surface distal from the pair of wheels and adapted to selectively engage at least one of the plurality of steps to impede forward movement of the patient transfer device as the pair of wheels move forwardly beyond the plurality of descending steps.

14. The patient transfer device of claim 13 wherein the braking surface is offset from the first track member to impede movement of the patient transfer device at the base of the plurality of steps.

15. The patient transfer device of claim 13 wherein the track extension includes a carrier and a grip pad.

16. The patient transfer device of claim 15 wherein the carrier includes an "L" shaped cross-section including a first web coupled to the first track member and a second web coupled to the grip pad.

17. The patient transfer device of claim 15 wherein the carrier includes left and right sidewalls for supporting the grip pad therebetween.

18. The patient transfer device of claim 17 wherein the grip pad is adhesively bonded to the carrier.

19. The patient transfer device of claim 13 wherein the seat assembly is adapted to support the occupant of the patient transfer device in at least one of the sitting position and the reclined position.

20. A patient transfer device comprising:

a seat assembly adapted to support an occupant of the patient transfer device;

a track assembly coupled to the seat assembly and including a first track member to support the patient transfer device across a plurality of steps;

a retractable wheel coupled to the track assembly and adapted to rotate between a deployed position and a stowed position, wherein the retractable wheel is biased in the deployed position by a biasing force; and a hand controller operatively coupled to the retractable wheel through a cable assembly, the hand controller being adapted to rotate the retractable wheel from the deployed position to the stowed position.

21. The patient transfer device of claim 20 wherein the cable assembly includes a mechanical advantage to overcome the biasing force.

22. The patient transfer device of claim 20 wherein the seat assembly is adapted to support the occupant of the patient transfer device in at least one of the sitting position and the reclined position.

* * * * *